US007128240B1

(12) United States Patent
Oesch

(10) Patent No.: US 7,128,240 B1
(45) Date of Patent: Oct. 31, 2006

(54) PILL DISPENSER

(76) Inventor: Mark B. Oesch, 603 E. 29th St., #22, Bryan, TX (US) 77803

( * ) Notice: Subject to any disclaimer, the term of this patent is extended or adjusted under 35 U.S.C. 154(b) by 445 days.

(21) Appl. No.: 10/664,612

(22) Filed: Sep. 17, 2003

Related U.S. Application Data

(60) Provisional application No. 60/411,373, filed on Sep. 17, 2002.

(51) Int. Cl.
*B65G 59/00* (2006.01)

(52) U.S. Cl. ..... 221/298; 221/299

(58) Field of Classification Search ..... 221/298, 221/299, 301, 207
See application file for complete search history.

(56) References Cited

U.S. PATENT DOCUMENTS 862,923 A * 8/1907 Linsley ..... 221/296
1,974,332 A * 9/1934 Hauck ..... 221/281
2,204,821 A * 6/1940 Priddy ..... 222/336
3,224,634 A * 12/1965 Semsch ..... 221/299
3,601,250 A 8/1971 Merila
3,746,154 A 7/1973 Gach
4,460,106 A 7/1984 Moulding, Jr. et al.
4,523,694 A 6/1985 Veltri
4,653,668 A * 3/1987 Gibilisco et al. ..... 221/298
5,791,515 A 8/1998 Khan et al.

* cited by examiner

*Primary Examiner*—David H. Bollinger
(74) *Attorney, Agent, or Firm*—Kenneth L Tolar

(57) ABSTRACT

A pill dispenser for use with a conventional pill bottle includes a hollow housing having an upper end with an internally threaded collar thereon for coupling the housing with the externally threaded neck of a conventional pill bottle. A tubular passageway extends from the upper end of the housing to the lower end. A spring-biased reciprocal plunger extends from a side of the housing that operates a gear actuated dispensing arm that pivots into and out of the passageway. By reciprocating the plunger, a user can individually dispense a pill through the lower end of the housing.

5 Claims, 1 Drawing Sheet

PILL DISPENSER

CROSS REFERENCE TO RELATED APPLICATIONS

This application is entitled to the benefit of provisional application No. 60/411,373 filed on Sep. 17, 2002.

BACKGROUND OF THE INVENTION

The present invention relates to a device that may be conveniently attached to a pill bottle allowing a user to individually dispense a pill therefrom.

DESCRIPTION OF THE PRIOR ART

Many vitamins and medications are typically produced in pill, capsule or tablet form, which are stored in bottles often having an instructional label thereon. The capsule bottle almost always includes a safety or childproof cap that is cumbersome and difficult to remove. Such caps are particularly troubling for the elderly or those afflicted with arthritis or similar ailments. In addition, once the cap has been removed, dispensing a single pill from the bottle is almost impossible.

Although various pill dispensers exist in the prior art, most include integral pill storage chambers requiring the pills to be transferred from the original container to the dispenser. Accordingly, it is usually not feasible to transfer the dosage and refill instructions from the original bottle to the dispenser.

A myriad of pill dispensers exist in the prior art. For example, U.S. Pat. No. 4,523,694 issued to Veltri discloses a dispensing cap including a stationary inner cap attached to a pill bottle neck, an outer cap rotatably connected to the inner cap and a rotor disposed therebetween. The inner cap, outer cap and rotor each have a discharge port which can be selectively aligned to dispense a single pill.

U.S. Pat. No. 4,460,106 issued to Moulding, Jr. et al. discloses a pill dispenser including multiple compartments each having slots or openings for allowing passage of pills therethrough. A second compartment is rotated to a first position whereby the openings in the first and second compartments are aligned allowing a pill to travel from the first compartment to the second compartment. The second compartment can then be rotated to a second position whereby the apertures on the first and second compartments are misaligned and the apertures on the second and third compartments are aligned allowing the pill to be dispensed from the second compartment.

U.S. Pat. No. 3,601,250 issued to Merila discloses a pill dispensing cap including a pair of chambers attached to a pill bottle each having a pill dispensing opening thereon. One of the chambers can be rotated relative to the other to align the openings.

U.S. Pat. No. 3,746,154 issued to Gach discloses a tablet dispenser having a tablet passageway with a gravity actuated retainer that slides across the passageway when the tablet bottle is tipped.

U.S. Pat. No. 5,791,515 issued to Khan et al. discloses a pill dispenser whereby rotation of the device in a first direction allows a pill to fall into a dispensing chamber; rotation in a reverse direction releases the pill onto a user's hand.

Each of the above described dispensers requires that a user rotate various components to effect the release of a pill, which requires both hands and is cumbersome, particularly for an elderly person. Furthermore, accurately aligning dispensing apertures to allow passage of a single pill can be nearly impossible. The present invention overcomes the above-described problems by providing a pill dispenser that can be quickly and conveniently attached to a conventional pill bottle for individually dispensing a pill therefrom. The dispenser includes a reciprocal plunger mechanism that is depressed to dispense a single pill from a dispensing chamber; furthermore, a cooperating spring mechanism simultaneously blocks passage of pills from the bottle to the dispensing chamber to assure that only a single pill is dispensed at any given time. The unique design also allows the device to be operated with one hand.

SUMMARY OF THE INVENTION

The present invention discloses a pill dispenser that attaches to a conventional medicine bottle or container. The device comprises a hollow housing having an upper end and a lower end with the upper end having an internally threaded collar thereon for coupling the housing to the externally threaded neck of a conventional pill bottle. Within the housing is a tubular passageway having a frustoconical entrance positioned proximal the upper end of the housing that is in communication with the pill bottle interior when the housing is properly secured thereto. Extending outwardly from the housing is a spring-biased plunger having an inboard portion and an outboard portion. On the inboard portion are a plurality of linear gear teeth that engage a rotary gear whereby reciprocation of the plunger results in rotation of the gear. A release arm is attached to the gear that pivots into and out of the passageway as the plunger is reciprocated to release a pill through a dispensing opening on the bottom of the passageway. At a distal end of the inboard portion are a plurality of separator springs that are thrust into the passageway when the plunger is depressed. The area between the separator springs and release arm defines a dispensing chamber. The springs, when thrust into the passageway, assure that only a single pill is positioned in the dispensing chamber at any one time. A biasing spring is likewise positioned on the distal end of the plunger and rests against the passageway outer wall to bias the plunger outwardly.

It is therefore an object of the present invention to provide a pill dispenser that allows a user to individually dispense pills from a conventional pill bottle.

It is another object of the present invention to provide a pill dispenser that can be used in conjunction with a conventional pill container allowing a user to retain instructional information thereon.

It is yet another object of the present invention to provide a dispenser that eliminates the need for a user to manipulate safety caps on conventional pill containers.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
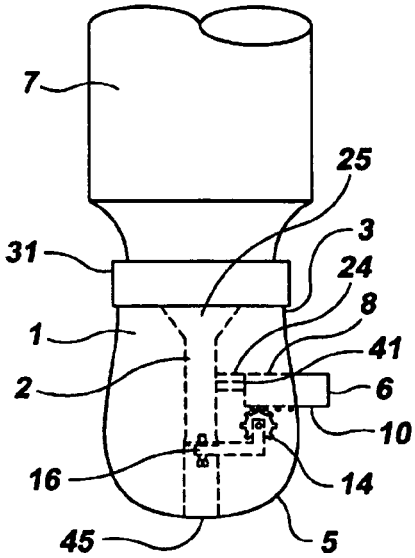
FIG. 1 depicts a front view of the dispenser properly secured to a conventional medicine bottle, with the internal components depicted in phantom.
Figure 2:
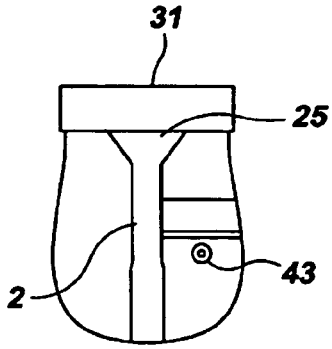
FIG. 2 is a front, cross-sectional view of the housing.
Figure 3:
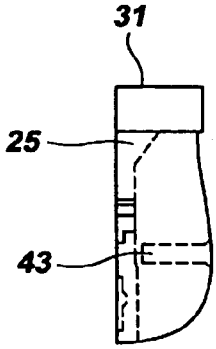
FIG. 3 is a cross-sectional view of the housing rotated 90° relative to the view depicted in FIG. 2, with the internal components depicted in phantom.

The present invention discloses a pill dispenser for use with a conventional medicine bottle. The device comprises a hollow housing 1 having an upper end 3 and a lower end 5 with the upper end having an internally threaded collar 31 thereon. The collar threadedly couples the housing to the externally threaded neck on a conventional pill bottle 7. The device could include an adapter for coupling the housing with varying sized bottles.

Within the housing is a tubular passageway 2 defined by a continuous outer wall extending from the upper end to the lower end. A top end of the passageway includes a frustoconical entrance 25 positioned at an upper end of the housing that is in communication with the pill bottle interior when the housing is properly secured thereto. The passageway also includes a bottom end in communication with a dispensing opening 45 on the lower end of the housing.

Figure 4:
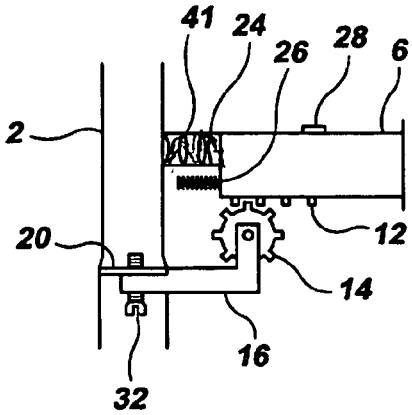
FIG. 4 is a detailed view of the plunger and pill release mechanism with the release arm in a restraining position.
Figure 5:
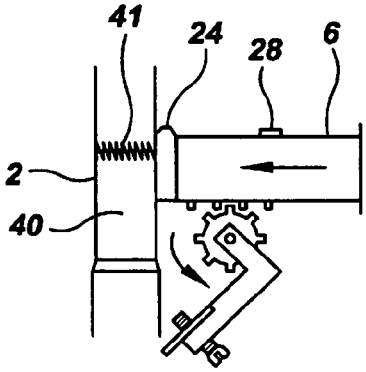
FIG. 5 is a detailed view of the plunger and release mechanism with the release arm pivoted to a release position.
Figure 6:
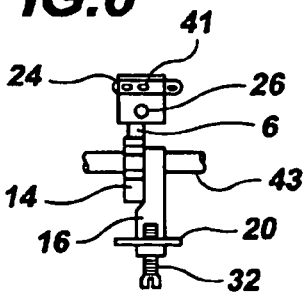
FIG. 6 is a detailed view of the pill release mechanism rotated 90° relative to the views depicted in FIGS. 4 and 5.

Extending outwardly from the housing is a spring-biased reciprocal plunger 6 having an inboard portion 8 and an outboard portion 10. On the inboard portion are a plurality of linear gear teeth 12 that engage a rotary gear 14 whereby reciprocation of the plunger rotates the gear. The rotary gear is supported by a boss 43. A release arm 16 is fixedly attached to the rotary gear that pivots into and out of the passageway, between a restraining and a release position. The arm moves into and out of the passageway through a slot as the plunger is reciprocated to selectively release a pill through the dispensing opening. A distal end of the arm has a disc shaped seal 20 thereon that seals the passageway when the arm pivots to the restraining position as depicted in FIG. 4.

At a distal end of the plunger inboard portion are a plurality of separator springs 41 that are thrust into passageway openings when the plunger is depressed. The area between the separator springs and the release arm defines a dispensing chamber 40. The separator springs are protected by an encapsulating rubber diaphragm 24 that also seals the passageway openings through which the springs are inserted and retracted. The separator springs prevent additional pills contained within the medicine container from falling into the dispensing chamber. Springs are an effective means for blocking the pills because they can easily penetrate conglomerated pills.

An adjustment screw 32 extends through the seal, which can be adjusted upwardly or downwardly to effectively vary the size of the dispensing chamber according to the pill size to assure that only one pill fits into the dispensing chamber. A biasing spring 26 is likewise positioned between the distal end of the plunger inboard portion and the passageway outer wall to bias the plunger outwardly from the housing. A stop member 28 on the inboard portion prevents the plunger from being completely ejected from the housing.

To use the above-described device, the lid on a pill container is removed and the housing collar is coupled with the threaded neck. The container is inverted so that pills within the container drop into the passageway entrance. The plunger is depressed to pivot the arm to a release position whereby a pill is delivered from the dispensing chamber through the dispensing opening. Contemporaneously, the separator springs are thrust into the passageway to prevent additional pills from dropping into the dispensing chamber. When the plunger is released, the arm pivots back to a restraining position with the seal tightly positioned within the passageway. Simultaneously, the biasing spring forces the springs out of the passageway allowing a pill to fall into the dispensing chamber.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pill dispenser comprising:

a housing having an upper end and a lower end, said upper end attachable to a pill storage container, said upper end having a pill entrance in communication with a pill container interior, said lower end having a pill dispensing opening thereon;

a pill passageway within said housing, said passageway extending from the entrance to the dispensing opening;

a plunger means mounted on said housing for selectively delivering a single pill from said pill container through said passageway to said dispensing opening wherein said plunger means includes a reciprocal plunger extending outwardly from the housing having an inboard portion and an outboard portion; gear teeth positioned on the inboard portion of said plunger; a rotary gear engaging said gear teeth; a release arm attached to said rotary gear, said release arm pivotal into and out of said passageway as said plunger is depressed and released to selectively release a pill through said dispensing opening.

2. The dispenser according to claim 1 further comprising a separator means for allowing a single pill to pass through said dispensing opening whenever said plunger is depressed.

3. The dispenser according to claim 2 wherein said separator means comprises:

a plurality of springs attached to the inboard portion of said plunger, said springs thrust into said passageway as said plunger is depressed, the area between said springs and said dispensing opening defining a dispensing chamber, said springs blocking said passageway preventing a pill from falling into said dispensing chamber.

4. The dispenser according to claim 3 further comprising an adjustment screw attached to a distal end of said release arm for varying the size of said dispensing chamber to accommodate varying sized pills.

5. The dispenser according to claim 1 further comprising a stop member attached to the inboard portion of said plunger for preventing said plunger from being detached from said housing.

* * * * *